US011454437B2

(12) United States Patent
Recine et al.

(10) Patent No.: US 11,454,437 B2
(45) Date of Patent: Sep. 27, 2022

(54) FROZEN SUBSTANCE MAKER

(71) Applicant: II-VI Delaware, Inc., Wilmington, DE (US)

(72) Inventors: Leonard Recine, Plano, TX (US); Jason Mefford, Garland, TX (US); James Bierschenk, Rowlett, TX (US); Joshua Moczygemba, Winona, TX (US)

(73) Assignee: II-VI DELAWARE, INC., Wilmington, DE (US)

( * ) Notice: Subject to any disclaimer, the term of this patent is extended or adjusted under 35 U.S.C. 154(b) by 243 days.

(21) Appl. No.: 16/377,745

(22) Filed: Apr. 8, 2019

(65) Prior Publication Data

US 2020/0318884 A1 Oct. 8, 2020

(51) Int. Cl.

| | |
|---|---|
| ***F25C 1/10*** | (2006.01) |
| ***F25B 21/04*** | (2006.01) |
| ***F25C 1/18*** | (2006.01) |

(52) U.S. Cl.

CPC ..... *F25C 1/10* (2013.01); *F25B 21/04* (2013.01); *F25C 1/18* (2013.01)

(58) Field of Classification Search

CPC ..... F25C 1/10; F25C 1/18; F25C 1/04; F25B 21/04

USPC ..... 62/3.2

See application file for complete search history.

(56) References Cited

U.S. PATENT DOCUMENTS

| | | | | | |
|---|---|---|---|---|---|
| 1,478,120 | A * | 12/1923 | Hill | F25D 17/02 | 62/461 |
| 3,203,189 | A * | 8/1965 | Vogt | G05D 23/01 | 62/383 |
| 3,502,081 | A * | 3/1970 | Amoils | A61B 18/02 | 606/24 |
| 4,519,389 | A * | 5/1985 | Gudkin | F25B 21/02 | 62/3.62 |
| 4,641,500 | A * | 2/1987 | Hosokawa | F25C 1/18 | 62/70 |
| 5,277,030 | A * | 1/1994 | Miller | A61B 18/02 | 607/104 |
| 5,535,592 | A * | 7/1996 | Mack | F25C 1/18 | 62/308 |
| 5,544,489 | A * | 8/1996 | Moren | F25B 21/02 | 62/183 |

(Continued)

OTHER PUBLICATIONS

First Office Action in counterpart Chinese Appl. 202010270347.3, dated Jun. 2, 2021.

*Primary Examiner* — Eric S Ruppert
*Assistant Examiner* — Kirstin U Oswald
(74) *Attorney, Agent, or Firm* — Blank Rome LLP

(57) ABSTRACT

The disclosure includes an apparatus and a method for forming a frozen substance using directional freezing. The apparatus includes a mold and a directional freezing assembly. The mold is structured with an interior chamber structured to contain a liquid substance. The directional freezing assembly includes a directional freezing probe and a cold plate. The directional freezing probe extends into the interior chamber of the mold and initiates directional freezing of the liquid substance surrounding the directional freezing probe. The cold plate is connected to the directional freezing probe outside of the mold and dissipates heat drawn from the directional freezing probe to a surrounding environment.

19 Claims, 9 Drawing Sheets

(56) References Cited

U.S. PATENT DOCUMENTS 5,613,364 A * 3/1997 Higgins ..... F25B 21/04 62/3.2
5,619,856 A * 4/1997 Lee ..... F25D 19/006 222/146.6
5,699,669 A * 12/1997 Gebhard ..... F25B 21/02 165/47
5,842,353 A * 12/1998 Kuo-Liang ..... F25B 21/04 219/419
5,860,280 A * 1/1999 Reci, Sr. ..... B67D 3/0009 62/400
5,946,918 A * 9/1999 Greene ..... F25D 31/003 62/393
6,112,541 A * 9/2000 Greene ..... B67D 1/0869 62/3.2
8,516,846 B2 * 8/2013 Lee ..... F25C 1/08 62/356
9,200,823 B2 12/2015 Boarman et al.
9,328,950 B2 5/2016 Schoonen
9,476,629 B2 10/2016 Boarman
9,599,388 B2 3/2017 Boarman et al.
9,915,459 B2 3/2018 Wu
2002/0162339 A1 * 11/2002 Harrison ..... H01L 35/30 62/3.2
2009/0049845 A1 * 2/2009 McStravick ..... A61M 5/003 62/3.62
2010/0089087 A1 * 4/2010 Stelmach ..... F25D 15/00 62/3.2
2010/0243570 A1 * 9/2010 Mayer ..... C02F 5/02 210/695
2015/0002142 A1 1/2015 Kubik
2015/0143838 A1 * 5/2015 Kim ..... F25C 5/02 62/340
2018/0087817 A1 3/2018 Little et al.

* cited by examiner

FROZEN SUBSTANCE MAKER

TECHNICAL FIELD

The present disclosure relates generally to forming a frozen substance. More specifically, the present disclosure relates to forming a frozen substance using a frozen substance maker including a mold and directional freezing probe.

BACKGROUND

Normal or cloudy ice is formed as a result of impurities being trapped within water as it freezes. These impurities typically include dissolved gases and minerals. The cloudiness of the ice forms when these impurities are trapped during formation of the crystal lattice which disrupts their alignment. The misaligned crystals refract ambient light back out instead of allowing the light to pass directly through, giving ice an opaque appearance.

Commercially available clear ice is not readily convenient or practical for home or personal use on a small scale. Commercially available frozen substances are inconvenient and costly, particularly in shapes such as spheres. Appliances that can form frozen substances such as clear ice are compressor-based, expensive, large, heavy, and limit the shape and size of the frozen substance to be formed. These appliances are impractical for home or personal use. The devices and techniques available for home or personal use require significant time and preparation while failing to consistently produce frozen substances such as clear ice.

SUMMARY

Embodiments of the present disclosure include an apparatus and method for forming a frozen substance.

In one embodiment, an apparatus to form a frozen substance using directional freezing comprises a mold and a directional freezing assembly. The mold is structured with a mounting hole located at a base of the mold and an interior chamber structured to contain a substance. The directional freezing assembly includes a thermoelectric heat pump and a directional freezing probe. The thermoelectric heat pump includes a supply side to provide cooling and heating functions based on a direction of input electricity across the thermoelectric heat pump. The directional freezing probe is thermally connected or attached to the supply side of the thermoelectric heat pump and extends through the mounting hole into the interior chamber of the mold. The directional freezing probe dissipates the cooling and heating functions of the thermoelectric heat pump and initiates directional freezing of the substance surrounding the directional freezing probe.

In another embodiment, an apparatus for forming a frozen substance using directional freezing comprises a mold and a directional freezing assembly. The mold is structured with a mounting hole located at a base of the mold and an interior chamber structured to contain a substance. The directional freezing assembly includes a directional freezing probe extending through the mounting hole into the interior chamber of the mold. The directional freezing assembly further includes a cold plate that is thermally connected or attached to the directional freezing probe outside of the mold structure and is configured to dissipate heat drawn from the directional freezing probe to a surrounding environment. The directional freezing probe is configured to initiate directional freezing of the substance surrounding the directional freezing probe.

In another embodiment, a method for forming a frozen substance using directional freezing comprises extending a directional freezing probe into an interior chamber of a mold through a mounting hole located at a base of the mold, wherein the directional freezing probe is thermally connected or attached to a supply side of a thermoelectric heat pump, inserting, into the interior chamber of the mold, a substance, providing, to the thermoelectric heat pump configured with the supply side, cooling and heating functions based on a direction of input electricity, dissipating the cooling and heating functions through the directional freezing probe, and initiating directional freezing of the substance surrounding the directional freezing probe.

Other technical features may be readily apparent to one skilled in the art from the following figures, descriptions, and claims.

Before undertaking the DETAILED DESCRIPTION below, it may be advantageous to set forth definitions of certain words and phrases used throughout the present disclosure. The term "couple" and its derivatives refer to any direct or indirect communication between two or more elements, whether or not those elements are in physical contact with one another. The terms "transmit," "receive," and "communicate," as well as derivatives thereof, encompass both direct and indirect communication. The terms "include" and "comprise," as well as derivatives thereof, mean inclusion without limitation. The term "or" is inclusive, meaning and/or. The phrase "associated with," as well as derivatives thereof, means to include, be included within, interconnect with, contain, be contained within, connect to or with, couple to or with, be communicable with, cooperate with, interleave, juxtapose, be proximate to, be bound to or with, have, have a property of, have a relationship to or with, or the like. The term "controller" means any device, system, or part thereof that controls at least one operation. Such a controller may be implemented in hardware or a combination of hardware and software and/or firmware. The functionality associated with any particular controller may be centralized or distributed, whether locally or remotely. The phrase "at least one of," when used with a list of items, means that different combinations of one or more of the listed items may be used, and only one item in the list may be needed. For example, "at least one of: A, B, and C" includes any of the following combinations: A, B, C, A and B, A and C, B and C, and A and B and C.

Moreover, various functions described below can be implemented or supported by one or more computer programs, each of which is formed from computer readable program code and embodied in a computer readable medium. The terms "application" and "program" refer to one or more computer programs, software components, sets of instructions, procedures, functions, objects, classes, instances, related data, or a portion thereof adapted for implementation in a suitable computer readable program code. The phrase "computer readable program code" includes any type of computer code, including source code, object code, and executable code. The phrase "computer readable medium" includes any type of medium capable of being accessed by a computer, such as read only memory (ROM), random access memory (RAM), a hard disk drive, a compact disc (CD), a digital video disc (DVD), or any other type of memory. A "non-transitory" computer readable medium excludes wired, wireless, optical, or other communication links that transport transitory electrical or other signals. A non-transitory computer readable medium includes media where data can be permanently stored and media where data can be stored and later overwritten, such as a rewritable optical disc or an erasable memory device.

Definitions for other certain words and phrases are provided throughout the present disclosure. Those of ordinary skill in the art should understand that in many if not most instances, such definitions apply to prior as well as future uses of such defined words and phrases.

BRIEF DESCRIPTION OF THE DRAWINGS

For a more complete understanding of this disclosure and its advantages, reference is now made to the following description, taken in conjunction with the accompanying drawings, in which like reference numerals represent like parts.

DETAILED DESCRIPTION

Figure 1:
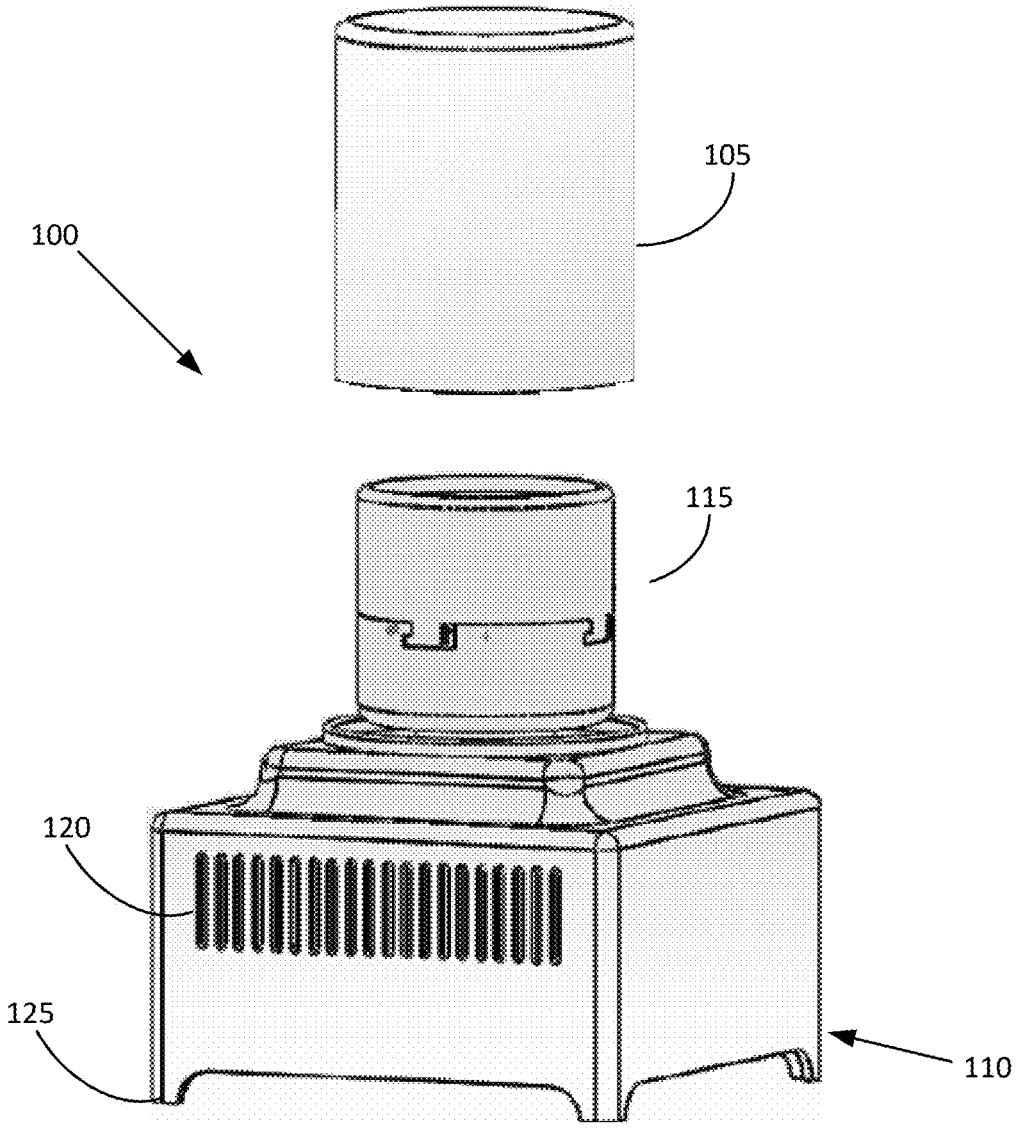
FIG. 1 illustrates a frozen substance maker according to various embodiments of the present disclosure.

FIGS. 1 through 6, discussed below, and the various embodiments used to describe the principles of the present disclosure are by way of illustration only and should not be construed in any way to limit the scope of the disclosure. Those skilled in the art will understand that the principles of the present disclosure may be implemented in any suitably arranged wireless communication system.

As used herein, the expression "configured to" may be interchangeably used with the expression "suitable for", "having the capability to", "designed to", "adapted to", "made to", or "capable of". The term "configured to" may not necessarily imply "specifically designed to" in hardware. Alternatively, in some situations, the expression "device configured to" may mean that the device, together with other devices or components, "is able to". For example, the phrase "processor adapted (or configured) to perform A, B, and C" may mean a dedicated processor (e.g., embedded processor) only for performing the corresponding operations or a generic-purpose processor (e.g., Central Processing Unit (CPU) or Application Processor (AP)) that can perform the corresponding operations by executing one or more software programs stored in a memory device.

The terms used in the present disclosure are only used to describe specific embodiments, and are not intended to limit the present disclosure. A singular expression may include a plural expression unless they are definitely different in a context. Unless defined otherwise, all terms used herein, including technical and scientific terms, have the same meaning as those commonly understood by a person skilled in the art to which the present disclosure pertains. Such terms as those defined in a generally used dictionary may be interpreted to have the meanings equal to the contextual meanings in the relevant field of art, and are not to be interpreted to have ideal or excessively formal meanings unless clearly defined in the present disclosure. In some cases, even the term defined in the present disclosure should not be interpreted to exclude embodiments of the present disclosure.

An example of a frozen substance with aligned crystals is clear ice. Clear ice is a frozen substance that does not include impurities in the crystal lattice formed by frozen molecules. Because the crystal lattice does not include impurities, clear ice is more pure and less cloudy than traditional ice. The crystals in the crystal lattice of clear ice are larger than the crystals in traditional ice. The crystals of traditional ice do contain impurities, which refract light and result in the cloudy or opaque appearance. Clear ice is not limited to water that is frozen and does not contain impurities. The clear ice discussed in the present disclosure includes frozen substances formed from any liquid substance, for example tonic water, tea, juices, or any other suitable substance.

Frozen substances with aligned crystals such as clear ice have a variety of benefits. For example, clear ice can be used in carbonated beverages to reduce the release of dissolved carbon dioxide from the beverage. Cloudy ice contains minerals, gases, or other impurities that are released into the beverage as the cloudy ice melts. The impurities contaminate the beverage and create nucleation sites upon melting that result in foaming and fizzing. Clear ice does not contain the impurities, resulting in decreased foaming and fizzing of carbonated beverages. The present disclosure provides a compact, light-weight apparatus that is convenient, economical, and versatile for home or personal use that consistently produces clear ice.

In directional freezing, the ice crystal formation starts at a surface that is closest to the freezing air and continues in a single direction. Directional freezing forces impurities out of the crystal lattice as it is formed, leaving aligned crystals that do not refract light.

In cascade freezing, a frozen substance can be formed with an aligned crystal lattice when a liquid substance continuously flows, or cascades, over the freezing outer surface. The action of the cascading liquid substance removes the dissolved impurities before they can become trapped in the crystal lattice, leaving aligned crystals. Most current implementations of forming a frozen substance with aligned crystals utilize cascade freezing. Artificially creating a frozen substance with aligned crystals using cascade freezing includes the use of a reservoir and a pump to maintain the continuous flow of the liquid substance over the freezing surface. This method has several disadvantages. For example, the pump is loud and takes up a substantial amount of space.

The terms "ice" or "clear ice" used throughout the disclosure are not limited to water. The terms "ice" or "clear ice" can be used to refer to any substance that can be frozen using the methods and apparatuses described herein. For example, substances such as tonic water, tea, juices, or any other suitable substance can be frozen such that the crystal lattice is aligned. When referring to the process in the current application, the terms "freezing" and "removing heat" can be used interchangeably. As is known in heat transfer, the process of cooling involves the transfer of heat away from the object being frozen.

FIG. 1 illustrates an example frozen substance maker 100 according to various embodiments of the present disclosure.

The frozen substance maker 100 can include an insulating cover 105, a housing 110, a directional freezing probe (the directional freezing probe 205 illustrated in FIG. 2), and a mold 115. Although illustrated in FIG. 1 as including each component, some embodiments can include additional components or omit some components.

The housing 110 includes vents 120 and a plurality of legs 125. The housing 110 can be structured to contain (or enclose) a thermoelectric heat pump (illustrated in FIG. 2). The housing 110 can support the directional freezing probe, the mold 115, and the insulating cover 105.

The vents 120 are formed in the housing 110 and allow heated air to dissipate from the waste side of the thermoelectric heat pump housed within the housing 110.

The housing 110 can be rested on a surface, such as a table or counter (not pictured). The plurality of legs 125 are located on the base of the housing 110 and raise the housing 110 above the surface to create a gap to further allow heated air originating from the waste side of the thermoelectric heat pump to circulate. By creating a gap between the surface and the housing 110, greater ventilation is provided for the thermoelectric heat pump. Greater ventilation for the thermoelectric heat pump reduces the likelihood of the thermoelectric heat pump overheating.

In some embodiments, the housing 110 can include a connection for an electrical connection to power the thermoelectric heat pump.

The mold 115 is structured to contain a substance. The substance can be in a liquid form when it is inserted into the mold 115 and is transformed into a frozen substance by the frozen substance maker 100. The substance can be water or any another substance that can be transformed from a liquid into a frozen substance with aligned crystals. For example, the substance can be tonic water, tea, juice, or any other suitable substance. The mold 115 is removable from the housing 110 and can be stored in a cooler or refrigerator after being removed from the housing 110 to prevent the frozen substance from melting.

The mold 115 can comprise two interlocking portions (a top cavity shell 410 and a base cavity shell 420 illustrated in FIGS. 4A-4D). The two interlocking portions can be combined to form an interior chamber (an interior chamber 450 illustrated in FIGS. 4A-4D). The two interlocking portions are combined and placed on the directional freezing probe before the substance is introduced into the interior chamber. The liquid substance is directionally frozen in the shape of the interior chamber to create a frozen substance that has an aligned crystal lattice. When the frozen substance that has an aligned crystal lattice has been formed, the mold 115 can be removed from the directional freezing probe and the two interlocking portions can be separated to allow the frozen substance that has an aligned crystal lattice to be removed.

The insulating cover 105 is a hollow structure that is open at one end with an inner diameter that is larger than an outer diameter of the mold 115. The insulating cover 105 can be placed over the mold 115 while the liquid substance is transformed into a frozen substance. The insulating cover 105 is structured to insulate the mold 115 by retaining cold air around the mold 115 when placed over the mold 115 while the liquid substance is transformed into the frozen substance.

The frozen substance maker 100 transforms the liquid substance into the frozen substance using directional freezing without cascading the liquid substance or a separate reservoir for liquid substance storage. The frozen substance maker 100 can form the frozen substance with an aligned crystal lattice without the additional complexity of a circulation pump because the substance is contained within the mold 115 rather than flowing during the frozen substance forming process.

Figure 2:
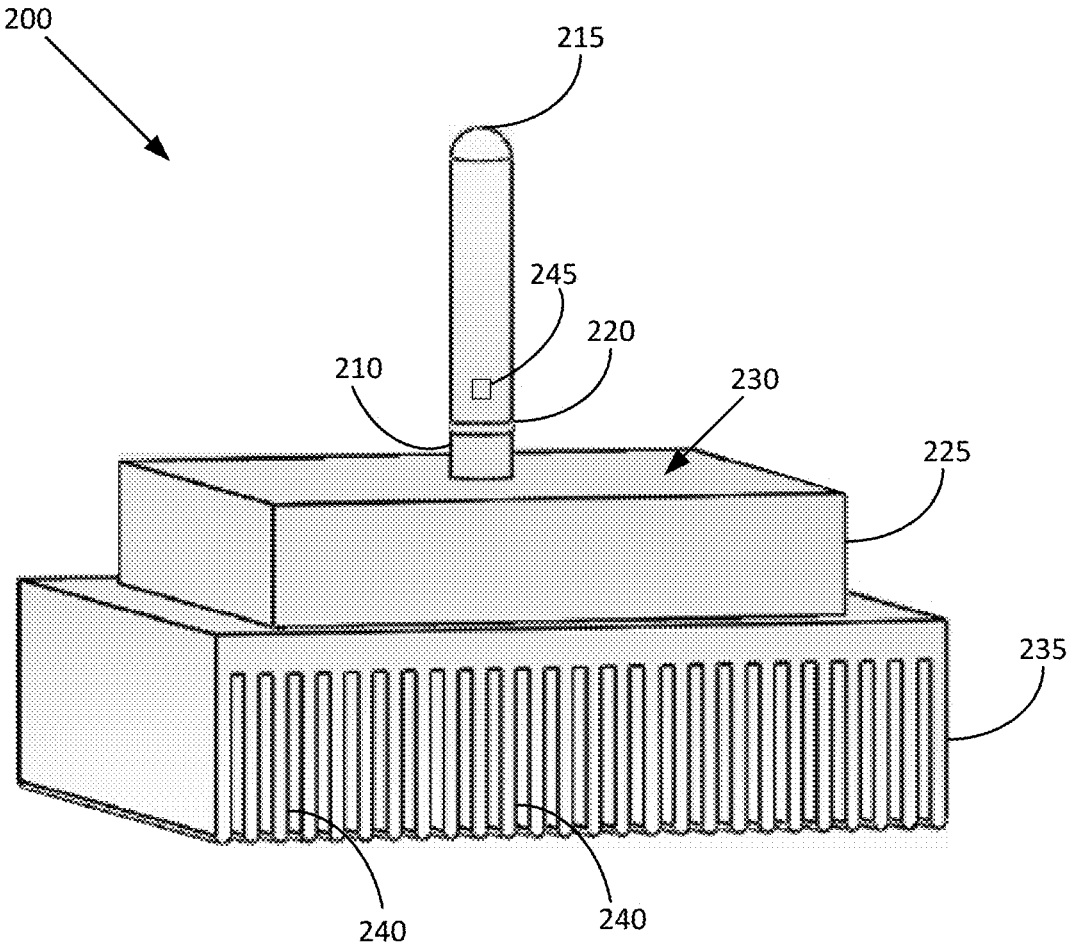
FIG. 2 illustrates a directional freezing assembly according to various embodiments of the present disclosure.

FIG. 2 illustrates a directional freezing assembly 200 according to various embodiments of the present disclosure. The directional freezing assembly 200 includes a directional freezing probe 205, a thermoelectric heat pump 225, and a heat sink 235. Although illustrated in FIG. 2 as including each component, some embodiments can include additional components or omit some components.

The directional freezing probe 205 is a thermal conductor used to initiate directional freezing of the substance contained within the mold 115. The directional freezing probe 205 can comprise a base 210, a tip portion 215, and a seal 220. The base 210 of the directional freezing probe 205 is thermally connected or attached to a supply side 230 of the thermoelectric heat pump 225. The tip portion 215 is structured to extend through a mounting hole (the mounting hole 440 illustrated in FIGS. 4B-4C) in the mold 115 into the interior chamber of the mold 115. A diameter of the base 210 is greater than or equal to a diameter of the tip portion 215. This configuration allows the directional freezing probe 205 to be removed from the mold 115 after the directional freezing process has been completed. The directional freezing probe 205 comprises a material with high thermal conductivity such as aluminum, copper, or another material with high thermal conductivity.

The directional freezing probe 205 can be provided in a variety of different shapes and sizes. In some embodiments, the base 210 of the directional freezing probe 205 can be cylindrical with a uniform circumference and the tip portion 215 can be a spherical cap. This structure results in the diameter of the tip portion 215 being equal to or smaller than the diameter of the base 210. In some embodiments, the entire directional freezing probe 205 can be tapered from where the base 210 is thermally connected or attached to the supply side 230 of the thermoelectric heat pump 225 to the tip portion 215. This structure results in the diameter of the tip portion 215 being smaller than the diameter of the base 210. In other embodiments, the directional freezing probe 205 can be formed in the shape of a dome.

In some embodiments, the directional freezing probe 205 can be shaped to minimize the possibility of flash freezing of the substance contained within the mold 115. Flash freezing occurs when a liquid substance is cooled below its freezing point and is not disturbed or agitated by an outside force. Once the liquid substance is sufficiently cooled, the liquid substance can be immediately frozen by relieving the pressure or agitating the liquid substance. Flash freezing has the disadvantage of causing impurities to become trapped in the substance as it freezes. A contributing factor to flash freezing is the shape of the freezing surface. For example, flash freezing is a greater probability if the thermal conductor is shaped in the form of a half sphere. The possibility of the liquid substance contained within the mold 115 being flash frozen can be minimized by utilizing geometric shapes other than a half sphere as the directional freezing probe 205 or controlling the temperature of the directional freezing probe 205.

In some embodiments, the directional freezing probe 205 can include detachable or retractable sections that remain in the substance after the liquid substance has been transformed into a frozen substance. For example, the directional freezing probe 205 can include a detachable portion that is placed on or over the directional freezing probe 205 that is frozen into or onto the substance during the directional freezing. When the frozen substance is removed from the directional freezing probe 205 and mold 115, the detachable portion of the directional freezing probe 205 remains in the frozen substance.

The seal 220 is seated in a groove that encompasses the diameter of the directional freezing probe 205 and is structured to be received by the mounting hole of the mold 115. The seal 220 is discussed in greater detail in the description of FIGS. 4A-4D. In some embodiments, the seal 220 can be an O-ring seal. Although presented herein as a directional freezing probe 205 including a seal 220 seated in a groove, other embodiments are possible. For example, the mold 115 can include a seal seated in a groove and the directional freezing probe 205 does not include a groove. In other embodiments, the seal 220 can be connected to the directional freezing probe 205 without being seated in a groove.

The thermoelectric heat pump 225 can be at least partially housed within the housing 110. As a non-limiting example, the thermoelectric heat pump 225 can be a Peltier device. For example, the thermoelectric heat pump 225 can include a single Peltier stage or multiple Peltier stages. The thermoelectric heat pump 225 can include a supply side 230. The directional freezing probe 205 is thermally connected or attached to the supply side 230 of the thermoelectric heat pump 225.

In some embodiments, the supply side 230 provides cooling and heating functions based on a direction of input electricity across thermoelectric heat pump 225. The base 210 of the directional freezing probe 205 can be thermally connected or attached to the supply side 230 of the thermoelectric heat pump 225. The directional freezing probe 205 can dissipate the cooling and heating functions of the thermoelectric heat pump 225.

When the thermoelectric heat pump 225 cools the directional freezing probe 205, a first thermal gradient is initiated at the directional freezing probe 205 and continues through the substance and the mold 115 to the surrounding environment. In addition, a second thermal gradient is created along the longitudinal axis of the directional freezing probe 205. The surface of the directional freezing probe 205 is the initiation point for the directional freezing of the substance within the mold 115. The characteristics of the second thermal gradient can be varied by changing the thermal resistance of the directional freezing probe 205. The thermal resistance of the directional freezing probe 205 can be changed by one or more of increasing or decreasing the length of the directional freezing probe 205, the diameter of one or more parts of the directional freezing probe 205, or creating the directional freezing probe 205 using materials of different thermal conductivities.

By cooling the directional freezing probe 205, directional freezing of the liquid substance within the mold 115 is initiated by harnessing the natural thermal resistance that exists between the surface of the directional freezing probe 205 and the liquid substance within the mold 115. The directional freezing of the substance begins on the portion of the substance nearest the directional freezing probe 205. As the liquid substance freezes around the directional freezing probe 205, creating the frozen substance, the thermal resistance increases and the substance gradually freezes in an outward direction away from the directional freezing probe 205 and toward the interior walls of the mold 115. In other words, the directional freezing begins in the center of the mold 115 and occurs gradually in a manner that the portion of substance furthest from the interior walls of the mold 115 is frozen before the portions of the substance nearest the interior walls of the mold 115. As freezing occurs, a crystal lattice is formed in the frozen substance. Because the directional freezing begins at the directional freezing probe 205 and extends to the inner wall of the mold 115, impurities dissolved in the substance are pushed out of the path of the crystal lattice as the crystal lattice is formed. As the impurities are pushed out of the crystal lattice, the crystal lattice aligns within the frozen substance.

Although presented herein as a single directional freezing probe 205 within a single mold 115, various embodiments are possible. In some embodiments, the directional freezing assembly 200 can include multiple directional freezing probes 205, each extendable into separate molds 115. In these embodiments, the frozen substance can be formed in multiple molds 115 simultaneously.

Although presented herein as the directional freezing probe 205 being separate from the mold 115, various embodiments are possible. For example, the directional freezing probe 205 can be included in the mold 115 that is thermally connected or exposed to a cold source such as the thermoelectric heat pump 225. The directional freezing probe 205 can have one end, for example the base 210, exposed to the cold source and the other end, for example the tip portion 215, penetrating the wall of the mold 115. The tip portion 215 can be shaped as a flat disc, a half sphere, a dome, or any other suitable shape.

In some embodiments, the directional freezing assembly 200 can be placed in a cool or cold environment such as a freezer or a refrigerator. Because the temperature is lower in the surrounding environment, the directional freezing assembly 200 the power input or time required to freeze the liquid substance can be decreased.

In some embodiments, the directional freezing probe 205 can include a food grade coating. For example, the coating can be Teflon or powder coating.

In some embodiments, the directional freezing probe 205 can include one or more nucleation sites 245. The one or more nucleation sites 245 can serve as an initial location on the directional freezing probe 205 where the directional freezing process begins. The one or more nucleation sites 245 can be an indentation or a raised portion, such as a bump, on the surface of the directional freezing probe 205.

In some embodiments, the directional freezing probe 205 can be retracted from the mold 115 during the directional freezing process. For example, after the directional freezing process has been initiated but before the directional freezing process has been completed, the directional freezing probe 205 can be fully or partially removed from the mold 115.

The thermoelectric heat pump 225 can be connected to a heat sink 235. The heat sink 235 is a type of heat exchanger and can include a plurality of fins 240 to dissipate heat away from the waste side of the thermoelectric heat pump 225. The fins 240 increase the surface area of the heat sink 235 to more effectively dissipate heat away from the waste side of the thermoelectric heat pump 225 and increase ambient cooling of the thermoelectric heat pump 225. In some embodiments, the thermoelectric heat pump 225 can include a fan to increase the dissipation of heat from the waste side of the thermoelectric heat pump 225.

The heat sink 235 can be supplemented by a phase change material (PCM) (for example, the PCM 380 illustrated in FIG. 3) to augment and improve the performance of the heat sink 235. The PCM supplements the heat sink 235 by providing a lower temperature environment increasing the temperature differential across the heat sink 235 from the waste side of the thermoelectric heat pump. Providing a greater differential between the hot and cold surfaces of the heat sink 235 increases the efficiency of the heat sink 235 and reduces the input power and time required to freeze the liquid substance. The PCM can be integrated into the heat sink 235 or attached to the heat sink 235 in direct thermal communication. In various embodiments, the PCM can be charged in a refrigerator or freezer prior to use in the directional freezing described herein.

Although illustrated in FIG. 2 as including the thermoelectric heat pump 225, some embodiments may substitute other means of a cooling device to cool the directional freezing probe 205. For example, the directional freezing assembly 200 can utilize a vapor compressor, Sterling cycle, absorption system, PCM, dry ice, or any other suitable means to cool the directional freezing probe 205.

In some embodiments, gas tubes can be created in the frozen substance during the directional freezing process. For example, streamers or spires can be formed in the frozen substance by freezing the substance quickly to trap dissolved gases. The dissolved gases radiate outward from the directional freezing probe 205 as they are trapped during the directional freezing process. The creation of gas tubes, such as streamers or spires, can be manipulated using a combination of different freeze rates, cold probe shapes, and surface finishes.

In some embodiments, agitation can be introduced to the directional freezing assembly 200 to induce energy or motion into the substance during the directional freezing process. The agitation can be presented through internal or external means to introduce features into the frozen substance such as patterns or to prevent flash freezing. The agitation can be presented through either mechanical or electro-mechanical means such as an ultrasonic transducer, a Piezoelectric motor, an off-balance fan, stirring, or any other suitable means. In some embodiments, the directional freezing assembly 200 can include an agitator (for example, the agitator 370 illustrated in FIG. 3).

Figure 3:
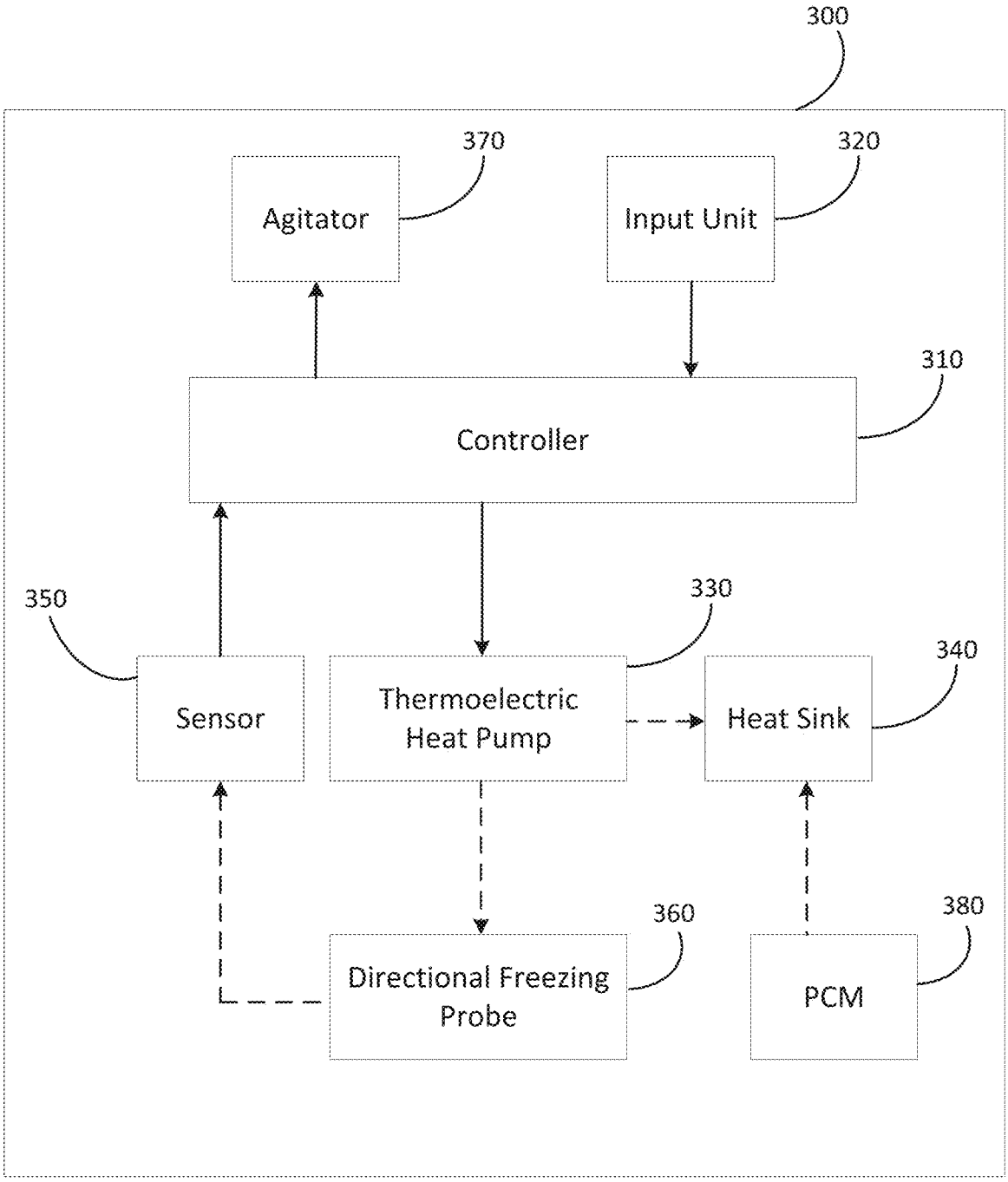
FIG. 3 illustrates a block diagram of a frozen substance maker according to various embodiments of the present disclosure.

FIG. 3 illustrates a block diagram of a frozen substance maker according to various embodiments of the present disclosure. In various embodiments, the frozen substance maker 300 can include a controller 310, an input unit 320, a thermoelectric heat pump 330, a heat sink 340, a sensor 350, and a directional freezing probe 360. In some embodiments, the frozen substance maker 300 can further include an agitator 370. Although illustrated in FIG. 3 as including each component, some embodiments can include additional components or omit some components. As illustrated in FIG. 3, the solid lines represent electrical signals and the broken lines represent the transfer of heat.

In some embodiments, the frozen substance maker 300 can be the frozen substance maker 100 or the directional freezing assembly 200. In some embodiments, the thermoelectric heat pump 330 can be the thermoelectric heat pump 225. In some embodiments, the heat sink 340 can be the heat sink 235. In some embodiments, the directional freezing probe 360 can be the directional freezing probe 205.

The controller 310 can control the thermal gradients of the directional freezing probe 360 by controlling the thermoelectric heat pump 330. The controller 310 can be a proportional controller or any other suitable type of controller. The controller 310 can actively control the thermal gradients of the directional freezing probe 360 as the directional freezing occurs. Active control of the directional freezing probe 360 can enable variable rates of freezing the liquid substance by controlling the rate at which the cooling function of the thermoelectric heat pump 330 is dissipated through the directional freezing probe 360.

Actively controlling the variable rate of directional freezing counteracts some of the challenges that arise with directional freezing. For example, if the rate of directional freezing is too high, impurities may not be fully removed from the crystal lattice resulting in cloudy ice. Actively controlling the rate of directional freezing can decrease the rate and form a frozen substance that is more pure. On the other hand, if the rate of directional freezing is too low, the amount of time to form the frozen substance can be too long. Actively controlling the rate of directional freezing can increase the rate and decrease the amount of time required to form the frozen substance without sacrificing the purity of the crystal lattice.

In some embodiments, active control can include a directional freezing probe 360 clearing cycle to allow for easier removal of the mold 115 from the directional freezing probe 360. In these embodiments, the active control can reverse the second thermal gradient of the directional freezing probe 360 after the liquid substance has been frozen in order to more easily remove the mold 115, including the frozen substance, from the directional freezing probe 360.

The sensor 350 can be a temperature sensor such as a thermistor or any other suitable type of sensor. The sensor 350 can measure a temperature of the directional freezing probe 360 in real time during the directional freezing process. For example, based on a desired rate to freeze the substance, the sensor 350 can sense the directional freezing probe 360 is cooling at a rate that is too high for the desired rate to freeze the substance. The controller 310 can receive a temperature reading of the directional freezing probe 360 from the sensor 350, and in response to the temperature reading control the thermoelectric heat pump 330 to decrease the rate at which the thermoelectric heat pump 330 dissipates a cooling function through the directional freezing probe 360. In another example, based on a desired rate to freeze the substance, the sensor 350 can sense the directional freezing probe 360 is cooling at a rate that is too low for the desired rate to freeze the substance. The controller 310 can receive a temperature reading of the directional freezing probe 360 from the sensor 350 and, in response to the temperature reading, control the thermoelectric heat pump 330 to increase the rate at which it dissipates a cooling function through the directional freezing probe 360.

The rate at which the waste side of the thermoelectric heat pump 330 dissipates heat can be increased by using a heat sink 340. The heat sink 340 can be supplemented by a phase change material (PCM) 380 to augment and improve the performance of the heat sink 340.

The input unit 320 can be any suitable unit through which a user can input a command to the frozen substance maker 300. For example, the input unit 320 can be a keypad, a touch pad, or the like. A user can preset a rate to freeze the substance using the input unit 320 before the substance has begun to freeze or change a rate to freeze the substance using the input unit 320 after the substance has begun to freeze.

The agitator 370 can introduce agitation to the frozen substance maker 300 to induce energy or motion into the substance during the directional freezing process. In various embodiments, the agitator 370 can be an ultrasonic transducer, a Piezoelectric motor, an off-balance fan, stirring, or any other suitable element to introduce agitation. The agitator 370 can be controlled by the controller 310.

Figure 4A:
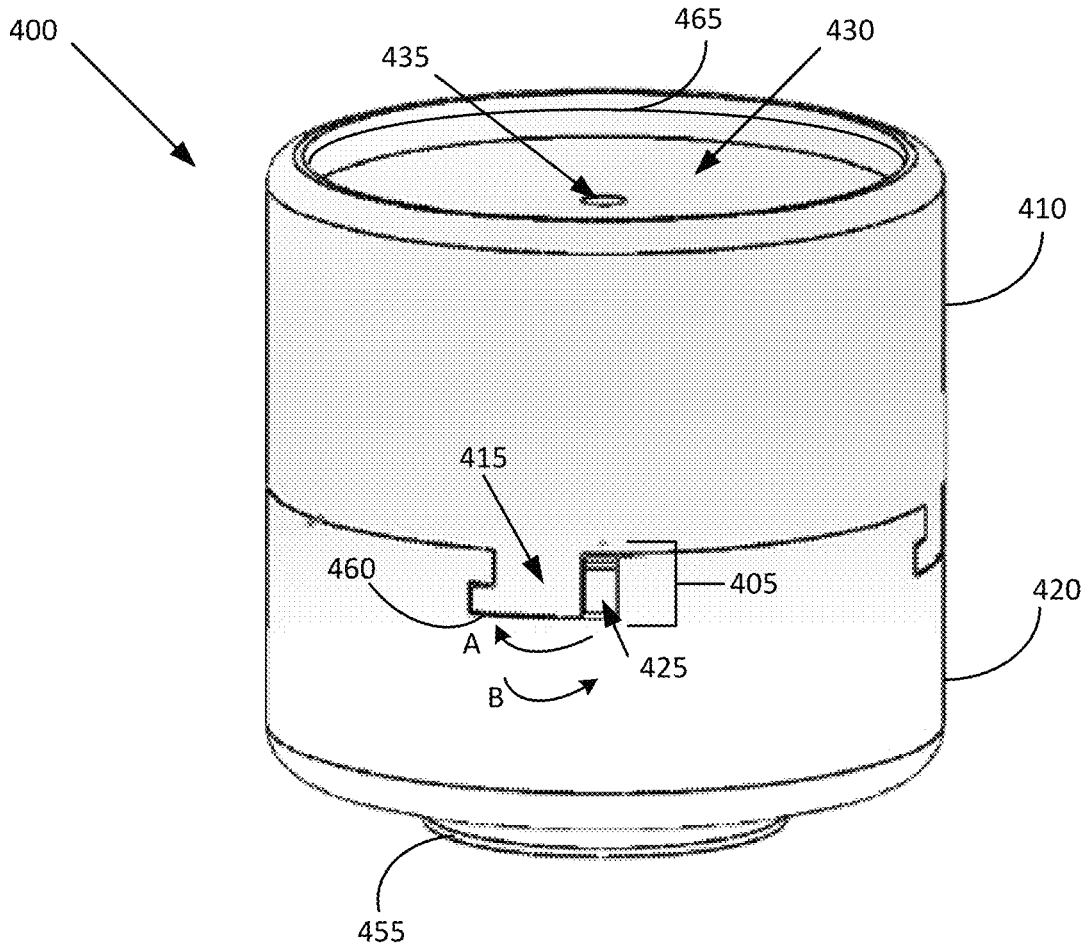
FIGS. 4A-4D illustrate a mold according to various embodiments of the present disclosure.
Figure 4B:
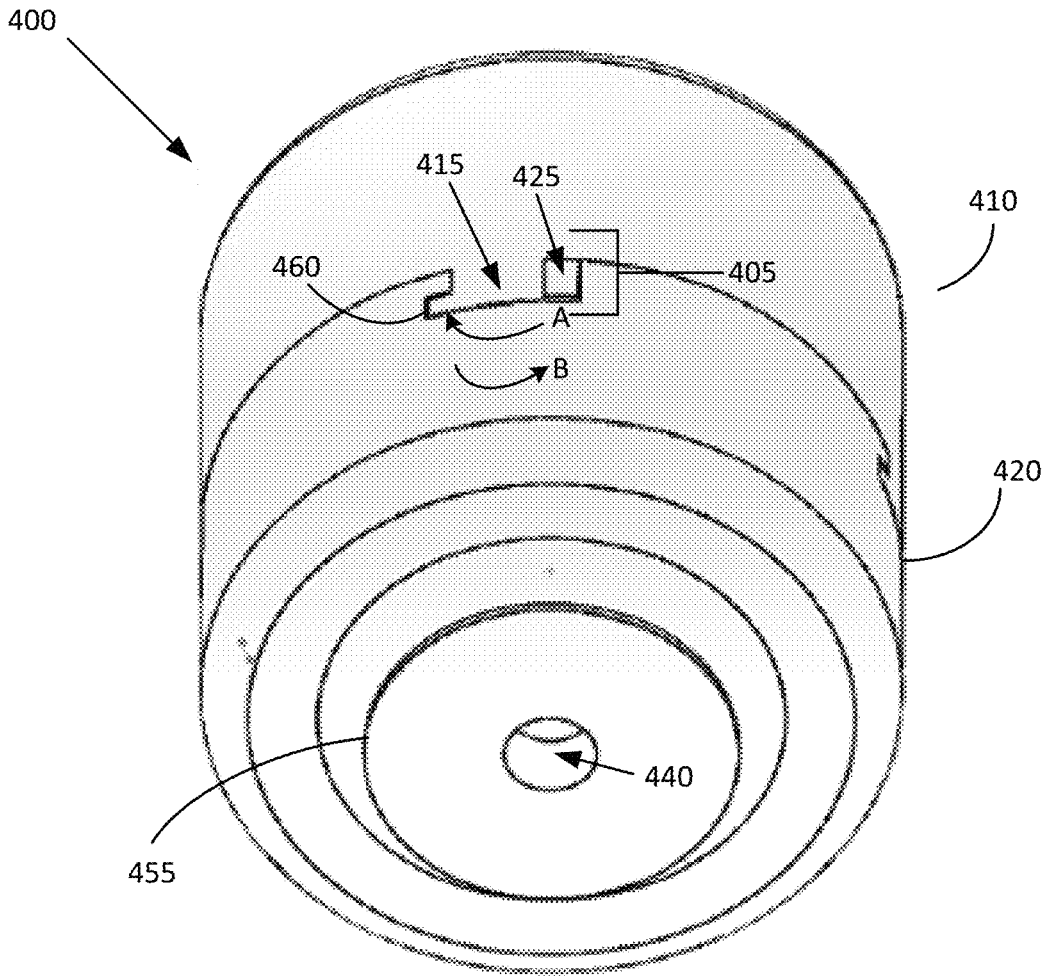
Figure 4C:
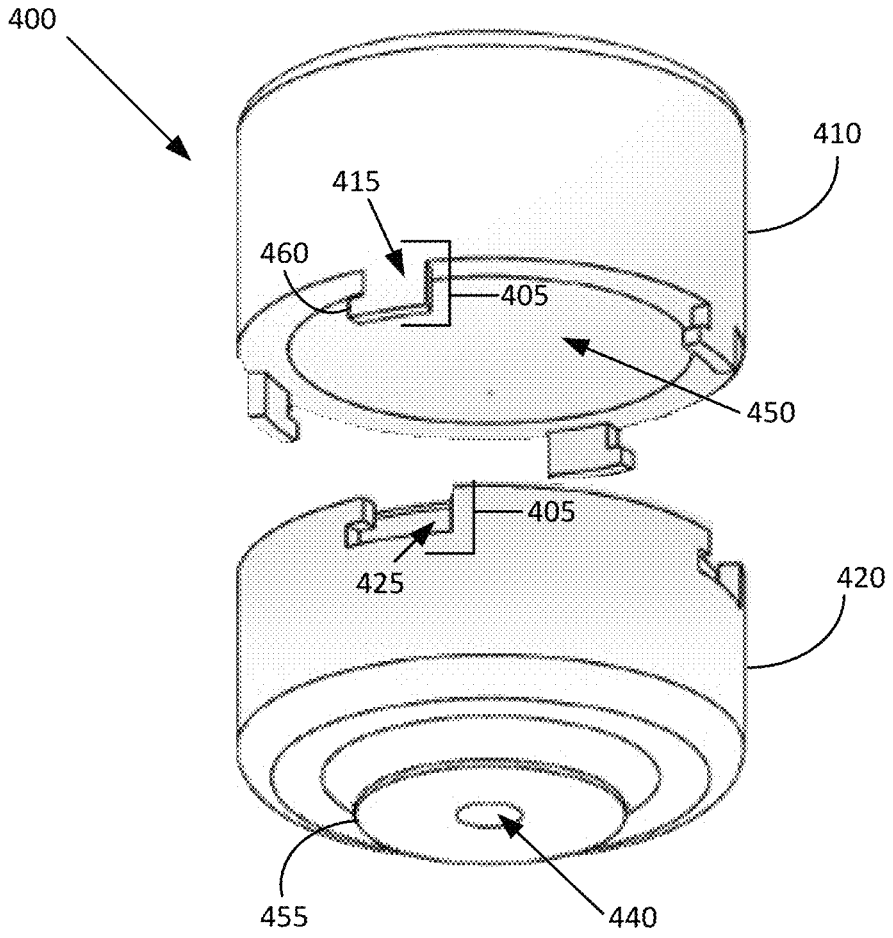
Figure 4D:
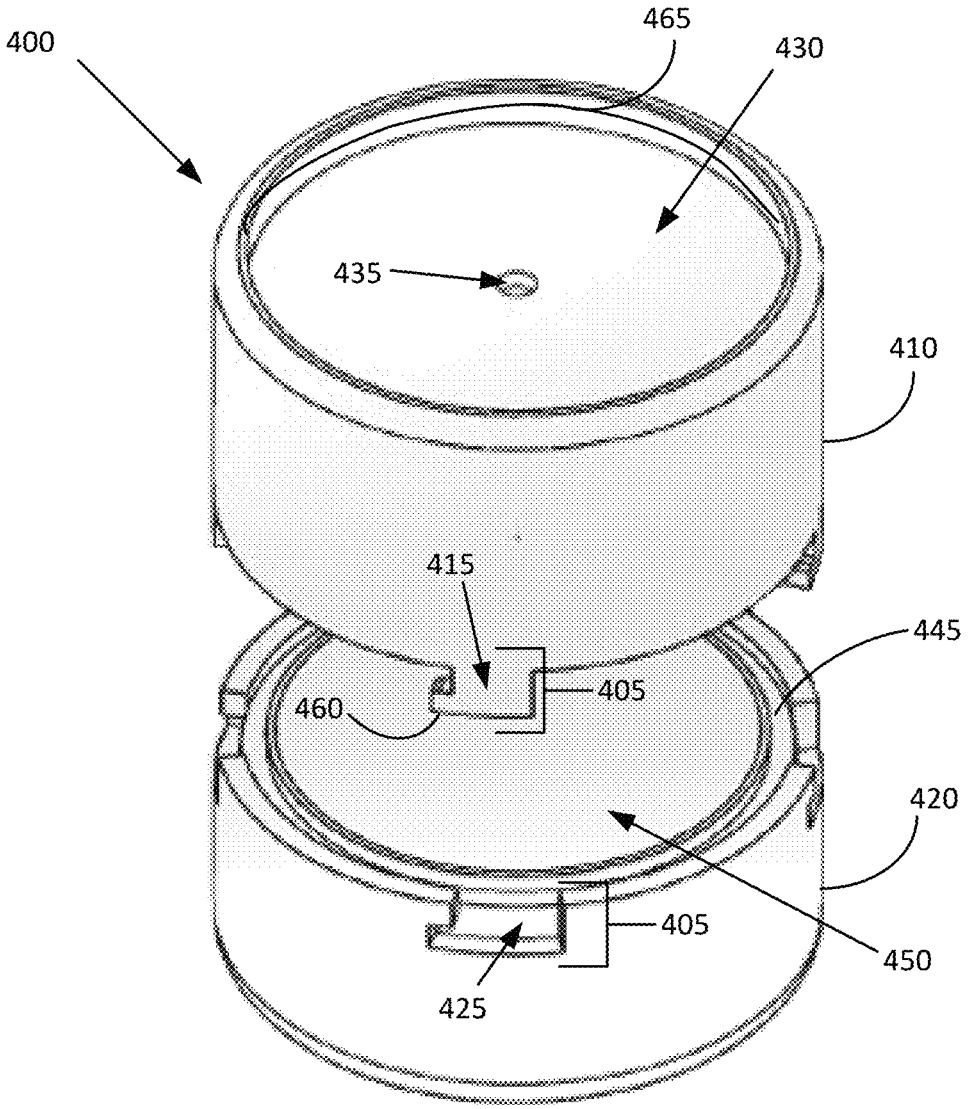

FIGS. 4A-4D illustrate various views of a mold 400 according to various embodiments of the present disclosure. FIG. 4A illustrates a side perspective view of the mold according to various embodiments of the present disclosure. FIG. 4B illustrates a bottom perspective view according to various embodiments of the present disclosure. FIG. 4C illustrates a bottom perspective exploded view according to various embodiments of the present disclosure. FIG. 4D illustrates a top perspective exploded view according to various embodiments of the present disclosure. In some embodiments, the mold 400 can be used as the mold 115.

Although illustrated in FIGS. 4A-4D as including each component, some embodiments can include additional components or omit some components.

The mold 400 comprises a top cavity shell 410 and a base cavity shell 420 that can be separated from each other. The top cavity shell 410 includes a recessed well 430 and a filler hole 435. The base cavity shell 420 includes a mounting hole 440. The mold 400 can also include a locking mechanism 405 that connects the top cavity shell 410 and the base cavity shell 420. The locking mechanism 405 can include one or more fingers 415 of the top cavity shell 410 and one or more boxes 425 of the base cavity shell 420 that correspond to the fingers 415. When the top cavity shell 410 and the base cavity shell 420 are connected via the locking mechanism 405, the interior chamber 450 is created.

The mold 400 includes an interior chamber 450 when the top cavity shell 410 and the base cavity shell 420 are combined and secured via the locking mechanism 405. The interior chamber 450 is structured to contain a substance that is initially a liquid and directionally frozen into a frozen substance with an aligned crystal lattice structure. In some embodiments, the substance can be water that is initially a liquid and directionally frozen into a frozen substance with an aligned crystal lattice structure. Although described herein as being water, any suitable substance can be directionally frozen into a substance with an aligned crystal lattice structure. For example, the substance can be tonic water, tea, juice, or any other suitable substance.

The interior chamber 450 of the mold 400 is formed when the top cavity shell 410 and the base cavity shell 420 are combined and then secured via the locking mechanism 405. The locking mechanism 405 includes each of the fingers 415 of the top cavity shell 410 and each of the boxes 425 of the base cavity shell 420. Each of the boxes 425 is structured in a manner that one of the boxes 425 can receive one of the fingers 415. After one of the fingers 415 has been received by one of the box 425, one of the fingers 415 can rotate in a first direction A to lock the top cavity shell 410 to the base cavity shell 420. Each of the fingers 415 includes a joint 460. When each of the fingers 415 have rotated in each of the boxes 425, each of the joints 460 are locked into place in a manner that the top cavity shell 410 cannot be vertically removed from the base cavity shell 420. When the top cavity shell 410 and the base cavity shell 420 have been combined via the locking mechanism 405, the interior chamber 450 is created.

The mold 400 can include a seal 445, illustrated for example in FIG. 4D, positioned between the top cavity shell 410 and the base cavity shell 420. For example, the seal 445 can be an O-ring seal. When the top cavity shell 410 and the base cavity shell 420 have been combined and secured via the locking mechanism 405, the combination compresses the seal 445. The compression of the seal 445 provides a tight seal preventing the substance from leaking out of the interior chamber 450 between the top cavity shell 410 and base cavity shell 420.

The interior chamber 450 is a hollow impression within the mold 400 and is created when the top cavity shell 410 and the base cavity shell 420 are combined via the locking mechanism. The interior chamber 450 is structured in a manner to be filled with a substance that is initially in liquid form and then directionally frozen into a frozen substance with an aligned crystal lattice structure. The interior chamber of the mold 115 can comprise any suitable shape to form the frozen substance, such as a sphere, a rectangular prism, a triangular prism, a logo, or any other suitable shape. In some embodiments, separate removable inserts can be added to the surface of the interior chamber 450 to form various features in the frozen substance.

Once the substance has been directionally frozen, the resulting frozen substance retains the shape of the interior chamber 450. For example, when the interior chamber 450 is a sphere, the frozen substance is in the shape of a sphere.

The interior chamber 450 is illustrated in FIGS. 4C and 4D. Although FIGS. 4C and 4D illustrate views of the mold 400 in which the top cavity shell 410 and the base cavity shell 420 are not combined via the locking mechanism 405, these views best illustrate the interior of the top cavity shell 410 and the base cavity shell 420. Accordingly, the portion of the interior chamber 450 created by the interior of the top cavity shell 410 is illustrated in FIG. 4C and the portion of the interior chamber 450 created by the interior of the base cavity shell 420 is illustrated in FIG. 4D.

The mold 400 is structured to provide thermal insulation for the substance within the interior chamber 450. The mold 400 can be formed of any suitable substance that is food safe and provides sufficient thermal insulation for freezing a liquid substance. For example, the mold 400 can be comprised of silicone, food safe metals, food safe polymers, food safe resins, or three-dimensional (3D) printed or sintered materials.

The thermal resistance of the mold 400 is critical in establishing the first thermal gradient and performing directional freezing. The first thermal gradient is initiated at the directional freezing probe 205 and continues through the substance and the mold 400 to the surrounding environment.

The recessed well 430 is located on an opposite end of the top cavity shell 410 from each of the fingers 415 and structured in a manner that the excess substance can be collected during the directional freezing process. In some embodiments, the recessed well 430 can include raised edges to collect an overflow of substance that contains impurities from the interior chamber 450. In some embodiments, the recessed well 430 can include a marking 465 to indicate when the substance has completed the directional freezing process. For example, the marking 465 can be a single mark on the entire circumference of the raised edge of the recessed well 430 or a series of marks on the raised edge of the recessed well 430.

The mold 400 can include a filler hole 435 located within the recessed well 430 and structured in a manner that the interior chamber 450 can be filled with the liquid substance through the filler hole 435. In some embodiments, the filler hole 435 can serve as ventilation for the substance as the substance is directionally frozen and expands.

In some embodiments, decorative items, shapes, or garnishes can be placed in the mold 400 prior to filling the mold 400 with the liquid substance through the filler hole 435. For example, decorative items, shapes, or garnishes can be inserted prior to assembling the top cavity shell 410 and the base cavity shell 420 together. The decorative items, shapes, or garnishes remain within the frozen substance after the liquid substance has been directionally frozen.

The mold 400 can also include a mounting hole 440 located at a base 455 of the mold 400. The mounting hole 440 is located on the opposite end of the base cavity shell 420 from each of the boxes 425. The mounting hole 440 is structured to receive the directional freezing probe 205. In other words, the mounting hole 440 is structured in a manner that the directional freezing probe 205 can be inserted into the mold 400 through the mounting hole 440. The mounting hole 440 can include a groove. The mounting hole 440 is configured to receive the seal 220 seated in a groove in the directional freezing probe 205. When a seal is formed between the seal 220 and the mold 400, the substance is prevented from leaking out of the mounting hole 440.

A user can determine the directional freezing process is completed based on an amount of substance frozen on the recessed well 430. After the directional freezing process has been completed, the substance within the interior chamber 450 is transformed from a liquid into a solid. After the directional freezing process has been completed, the mold 400 can be removed from the directional freezing probe 205. The mold 400 can then be raised until the directional freezing probe 205 has been withdrawn from the interior chamber 450 through the mounting hole 440. Because the diameter of the base 210 is greater than or equal to the diameter of the tip portion 215, the directional freezing probe 205 can be removed from the mounting hole 440 with ease.

Although described herein as a directional freezing probe 205 that includes a seal 220 seated in a groove that is received by the mold 400, other embodiments are possible. For example, the mold 400 can include a seal that seats in a groove and accepts the directional freezing probe 205.

Following the removal of the directional freezing probe 205 from the mounting hole 440, the frozen substance remains in the interior chamber 450. The frozen substance can remain within the mold 400 for an indefinite period of time until the frozen substance is removed from the mold 400. For example, the mold 400 can be placed in a freezer or cooler to maintain the frozen substance's frozen state.

After the frozen substance is formed, the frozen substance within the mold 400 includes a void where the directional freezing probe 205 was inserted into the mold 400. In some embodiments, an additional substance such as a flavoring or garnish can be inserted into the void in the frozen substance before the mold 400 is placed in a freezer or cooler. For example, the mold 400 can be positioned such that the base cavity shell 420 is positioned on top of the top cavity shell 410 with the mounting hole 440 in an upwards position. The flavoring or garnish can be added to the frozen substance through the mounting hole 440 before the mold 400 is placed in the freezer or cooler. In embodiments where the flavoring or garnish is originally in a liquid state, the flavoring or garnish freezes while the mold 400 is in the freezer or cooler. At a later point in time when the frozen substance is removed from the mold 400 and used to cool a beverage, the flavoring or garnish can be gradually dispersed through the beverage as the flavoring or garnish melts.

The frozen substance can be removed from the interior chamber 450 by separating the top cavity shell 410 and the base cavity shell 420 of the mold 400 and removing the frozen substance. The top cavity shell 410 and the base cavity shell 420 can be separated by unlocking the locking mechanism 405. To unlock the locking mechanism 405, each of the fingers 415 are rotated in a second direction B, which is opposite the first direction A, in a manner that each of the joints 460 are free from each of the boxes 425. Once the joints 460 are free, the top cavity shell 410 can be vertically removed from the base cavity shell 420. Once the top cavity shell 410 and the base cavity shell 420 are separated, the directionally frozen substance can be removed from the mold 400.

Figure 5:
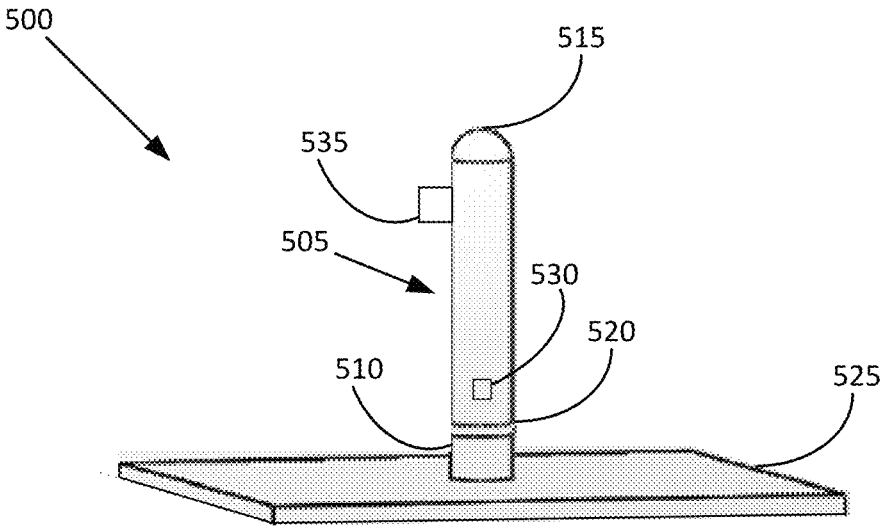
FIG. 5 illustrates a directional freezing assembly according to various embodiments of the present disclosure.

FIG. 5 illustrates a directional freezing assembly according to various embodiments of the present disclosure. The directional freezing assembly 500 includes a directional freezing probe 505 and a cold plate 525. Although illustrated in FIG. 5 as including each component, some embodiments can include additional components or omit some components.

The directional freezing probe 505 is a thermal conductor used to initiate directional freezing of the substance contained within the mold 400. The directional freezing probe 505 can comprise a base 510, a tip portion 515, and a seal 520. The base 510 of the directional freezing probe 505 is thermally connected or attached to the cold plate 525. The tip portion 515 is structured to extend through the mounting hole 440 in the mold 400 into the interior chamber 450 of the mold 400. A diameter of the base 510 is greater than or equal to a diameter of the tip portion 515. This configuration allows the directional freezing probe 505 to be removed from the mold 400 after the directional freezing process has been completed. The directional freezing probe 505 comprises a material with high thermal conductivity such as aluminum, copper, or another material with high thermal conductivity.

The directional freezing probe 505 can be provided in a variety of different shapes and sizes. In some embodiments, the base 510 of the directional freezing probe 505 can be cylindrical with a uniform circumference and the tip portion 515 can be a spherical cap. This structure results in the diameter of the tip portion 515 being equal to or smaller than the diameter of the base 510. In some embodiments, the entire directional freezing probe 505 can be tapered from where the base 510 is thermally connected or attached to the cold plate 525 to the tip portion 515. This structure results in the diameter of the tip portion 515 being smaller than the diameter of the base 510.

In some embodiments, the directional freezing probe 505 can be shaped to minimize the possibility of flash freezing of the substance contained within the mold 400. Flash freezing occurs when a liquid substance is cooled below its freezing point and is not disturbed or agitated by an outside force. Once the liquid substance is sufficiently cooled, the liquid substance can be immediately frozen by relieving the pressure or agitating the liquid substance. Flash freezing has the disadvantage of causing impurities to become trapped in the substance as it freezes. A contributing factor to flash freezing is the shape of the freezing surface. For example, flash freezing is a greater probability if the thermal conductor is shaped in the form of a half sphere. The possibility of the liquid substance contained within the mold 400 being flash frozen can be minimized by utilizing geometric shapes other than a half sphere as the directional freezing probe 505 or controlling the temperature of the directional freezing probe 505.

In some embodiments, the directional freezing probe 505 can include detachable or retractable portions 535 that remain in the substance after the liquid substance has been transformed into a frozen substance. For example, the directional freezing probe 505 can include a detachable portion 535 that is placed on or over the directional freezing probe 505 that is frozen into or onto the substance during the directional freezing. When the frozen substance is removed from the directional freezing probe 505 and mold 400, the detachable portion 535 of the directional freezing probe 505 remains in the frozen substance.

The seal 520 is seated in a groove that encompasses the diameter of the directional freezing probe 505 and is structured to be received by the mounting hole 440 of the mold 400. In some embodiments, the seal 520 can be an O-ring seal. Although presented herein as a directional freezing probe 505 including a seal 520 seated in a groove, other embodiments are possible. For example, the mold 400 can include a seal that is seated in a groove and accepts the directional freezing probe 505. In other embodiments, the seal 520 can be connected to the directional freezing probe 505 without being seated in a groove.

The cold plate 525 supports the directional freezing probe 505. The cold plate 525 can be any suitable size or shape that supports the directional freezing probe 505, such as a square, rectangle, or circle. For example, a cold plate 525 with a large amount of surface area can be used to increase the amount of cold air from the surrounding environment that is dissipated through the directional freezing probe 505. The cold plate 525 can be made of the same material as the directional freezing probe 505. For example, the cold plate 525 comprises a material with high thermal conductivity such as aluminum, copper, or another material with high thermal conductivity.

The directional freezing assembly 500 can be placed in a cool or cold environment such as a freezer or a refrigerator. When the directional freezing assembly 500 is cooled by the cold air in the freezer, the cold plate 525 is gradually cooled which in turn cools the directional freezing probe 505. Because the temperature is lower in the surroundings, the cold plate 525 can "draw" the heat out of the substance in the mold through the directional freezing directional freezing probe 505, effectively cooling or freezing the substance inside the mold. The greater the surface area of the cold plate 525, the more rapidly the cold plate 525 is cooled. The surface area of the cold plate 525 can be increased by adding extended surfaces, such as fins, to the exposed side of the cold plate 525. Adding extended surfaces, such as fins, to the exposed side of the cold plate 525 increases the cooling efficiency of the directional freezing assembly 500. As the cold plate 525 is cooled, the coolness is transferred through the directional freezing probe 505 and a first is initiated at the directional freezing probe 505 and continues through the substance and the mold 400 to the surrounding environment. In addition, a second thermal gradient is created along the longitudinal axis of the directional freezing probe 505.

There is an interdependence between the time necessary to completely freeze the substance and characteristics of the directional freezing assembly 500 such as the surface area of the directional freezing probe 505, temperature of the directional freezing probe 505, rate of heat removal, and increasing the thermal resistance through the ice as it is formed. For example, if the freezing rate is too rapid, impurities can become trapped in the crystal lattice resulting in the formation of cloudy ice. The characteristics of the second thermal gradient can be varied by changing the thermal resistance of the directional freezing probe 505.

The thermal resistance of the directional freezing probe 505 can be changed by one or more of increasing or decreasing the length of the directional freezing probe 505, the diameter of one or more parts of the directional freezing probe 505, or creating the directional freezing probe 505 using materials of different thermal conductivities. For example, the thermal resistance along the longitudinal axis can be increased by increasing the length of the directional freezing probe 505 or by decreasing the diameter of one or more parts of the directional freezing probe 505 while maintaining a constant length of the directional freezing probe 505.

Increasing the length of the directional freezing probe 505, increasing the diameter of the directional freezing probe 505, or both results in greater surface area of the directional freezing probe 505 to be cooled. When the surface area, and subsequently the mass, of the directional freezing probe 505 is increased, the time needed to cool the directional freezing probe 505 is increased accordingly. On the other hand, decreasing the length of the directional freezing probe 505, decreasing the diameter of the directional freezing probe 505, or both results in less surface area and subsequently less mass of the directional freezing probe 505 to be cooled. When the surface area of the directional freezing probe 505 is decreased, the time needed to cool the directional freezing probe 505 is decreased accordingly.

By cooling the directional freezing probe 505, directional freezing of the liquid substance within the mold 400 is initiated by harnessing the natural thermal resistance that exists between the surface of the directional freezing probe 505 and the liquid substance within the mold 400. The directional freezing of the substance begins on the portion of the substance nearest the directional freezing probe 505. As the liquid substance freezes around the directional freezing probe 505, creating the frozen substance, the thermal resistance increases and the substance gradually freezes in an outward direction away from the directional freezing probe 505 and toward the interior walls of the mold 400. In other words, the directional freezing begins in the center of the mold 400 and occurs gradually in a manner that the portion of substance furthest from the interior walls of the mold 400 is frozen before the portions of the substance nearest the interior walls of the mold 400. As freezing occurs, a crystal lattice is formed in the frozen substance. Because the directional freezing begins at the directional freezing probe 505 and extends to the inner wall of the mold 400, impurities dissolved in the substance are pushed out of the path of the crystal lattice as the crystal lattice is formed. As the impurities are pushed out of the crystal lattice, the crystal lattice aligns within the frozen substance.

Although presented herein as a single directional freezing probe 505 within a single mold 400, various embodiments are possible. In some embodiments, the directional freezing assembly 500 can include multiple directional freezing probes 505, each extendable into separate molds 400, to form the frozen substance in multiple molds 400 simultaneously. For example, a single cold plate 525 can support multiple directional freezing probes 505. As another example, the directional freezing assembly 500 can include multiple cold plates 525 that each support a single directional freezing probe 505. By using a separate cold plate 525 for each directional freezing probe 505, the ratio of surface area on the cold plate 525 to surface area of the directional freezing probe 505 is maintained, causing the directional freezing to occur more efficiently.

Although presented herein as the directional freezing probe 505 being separate from the mold 400, various embodiments are possible. For example, the directional freezing probe 505 can be included in the mold 400 that is thermally connected or exposed to a cold source such as the cold plate 525. The directional freezing probe 505 can have one end, for example the base 510, exposed to the cold plate 525 and the other end, for example the tip portion 515, penetrating the wall of the mold 400. The tip portion 515 can be shaped as a flat disc, a half sphere, a dome, or any other suitable shape.

In some embodiments, the directional freezing probe 505 can include a food grade coating. For example, the coating can be Teflon or powder coating.

The surface of the directional freezing probe 505 is the initiation point for the directional freezing of the substance within the mold 400. In some embodiments, the directional freezing probe 505 can include one or more nucleation sites 530. The one or more nucleation sites 530 can serve as an initial location on the directional freezing probe 505 where the directional freezing process begins. The one or more nucleation sites 530 can be an indentation or a raised portion, such as a bump, on the surface of the directional freezing probe 505.

In some embodiments, gas tubes can be created in the frozen substance during the directional freezing process. For example, streamers or spires can be formed in the frozen substance by freezing the substance quickly to trap dissolved gases. The dissolved gases radiate outward from the directional freezing probe 205 as they are trapped during the directional freezing process. The creation of gas tubes, such as streamers or spires, can be manipulated using a combination of different freeze rates, cold probe shapes, and surface finishes.

In some embodiments, agitation can be introduced to the directional freezing assembly 500 to induce energy or motion into the substance during the directional freezing process. The agitation can be presented through internal or external means to introduce features into the frozen substance such as patterns or to prevent flash freezing. The agitation can be presented through either mechanical or electro-mechanical means such as an ultrasonic transducer, a Piezoelectric motor, an off-balance fan, stirring, or any other suitable means.

Figure 6:
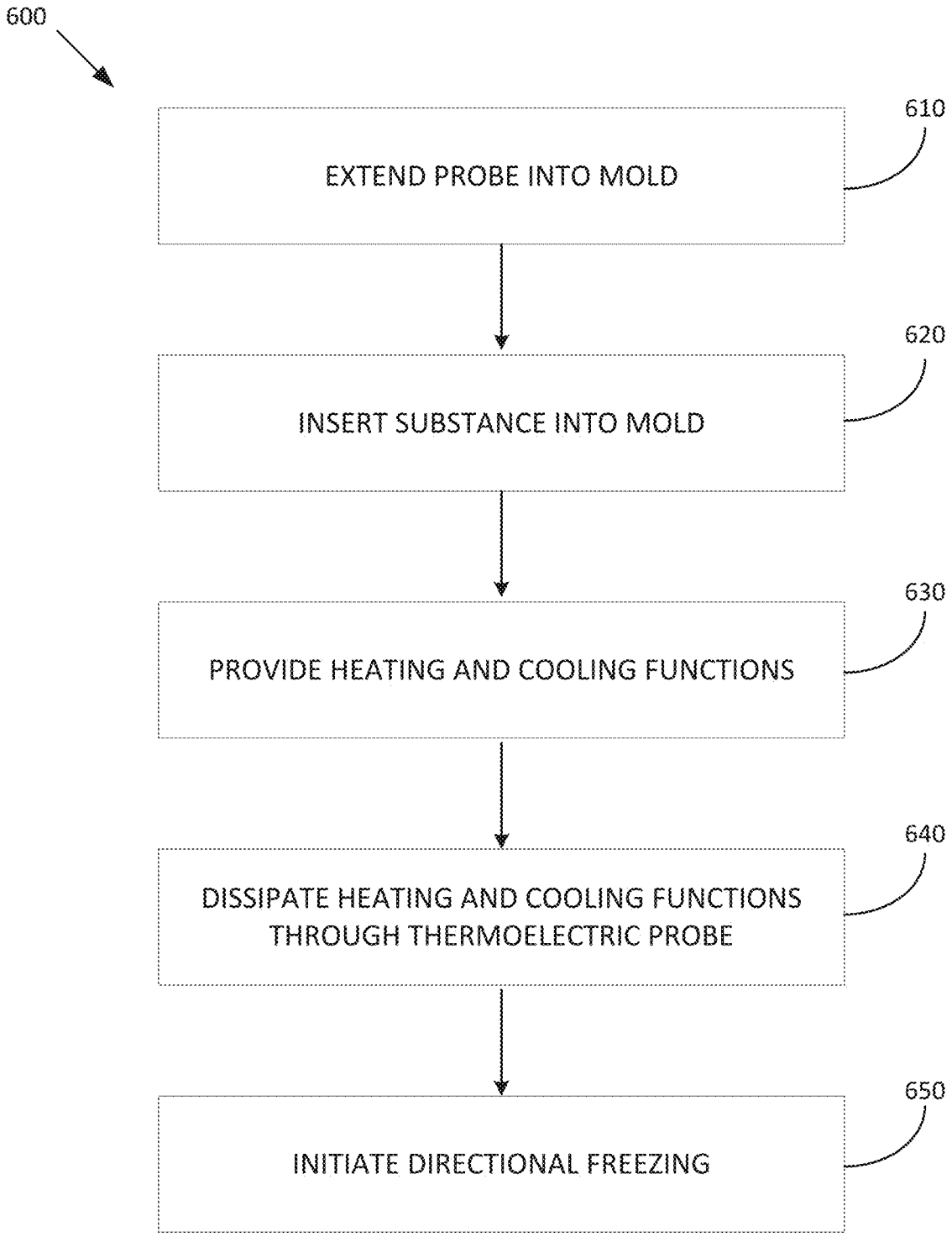
FIG. 6 illustrates a method for forming a frozen substance according to various embodiments of the present disclosure.

FIG. 6 illustrates a method 600 for forming a frozen substance that has an aligned crystal lattice according to various embodiments of the present disclosure. For example, the process in FIG. 6 can be performed using the frozen substance maker 100 in FIG. 6. The method begins with extending a probe into a mold.

In operation 610, the directional freezing probe 205 extends into the mold 400. The top cavity shell 410 and the base cavity shell 420 can be locked and secured via the locking mechanism 405, forming the interior chamber 450. The interior chamber 450 can be formed before the directional freezing probe 205 extends into the mold 400 or after the directional freezing probe 205 has been extended into the mounting hole 440. In some embodiments, extending the directional freezing probe 205 into the mold 400 includes creating a seal between the seal 220 of the directional freezing probe 205 and the mounting hole 440. Creating a seal between the directional freezing probe 205 and the mounting hole 440 prevents leakage of a substance from the mold 400 in subsequent operations.

In operation 620, a liquid substance is inserted into the mold 400. The interior chamber 450 of the mold 400 contains the liquid substance after the liquid substance has been inserted into the mold 400. The substance is initially a liquid substance when it is inserted into the mold 400. The substance can be inserted into the mold 400 via the filler hole 435. In some embodiments, the liquid substance can be contained within the interior chamber 450 for the remaining duration of the method. The substance can be any substance that can be frozen in such a way as to align the crystal lattice of the molecules. For example, the substance can be water, tonic water, tea, juice, or any other suitable substance.

In operation 630, heating and cooling functions are provided via the thermoelectric heat pump 225. The thermoelectric heat pump 225 includes a supply side 230 thermally connected or attached to the directional freezing probe 205 and a waste side. Heating and cooling functions can be provided from an electrical connection that powers the thermoelectric heat pump 225.

In operation 640, the heating and cooling functions of the thermoelectric heat pump 225 are dissipated through the directional freezing probe 205. As the directional freezing probe 205 is cooled, a first thermal gradient is initiated at the directional freezing probe 205 and continues through the substance and the mold 400 to the surrounding environment. In addition, a second thermal gradient is created along the longitudinal axis of the directional freezing probe 205. The cooling function of the thermoelectric heat pump 225 is dissipated through the directional freezing probe 205. The heating function of the directional freezing probe 205 is dissipated through the waste side of the thermoelectric heat pump 225. For example, the thermoelectric heat pump 225 can include a heat sink 235 that includes a plurality of fins 240 to dissipate heat away from the waste side of the thermoelectric heat pump 225.

In operation 650, directional freezing of the liquid substance contained within the mold 400 is initiated. Directional freezing is initiated by the natural thermal resistance between the liquid substance contained within the mold 400 and the second thermal gradient of the cooled surface of the directional freezing probe 205. Through directional freezing, the substance contained within the mold 400 is transformed into a frozen substance that has an aligned crystal structure.

Directional freezing of the substance begins at the directional freezing probe 205 and forms a frozen substance at the directional freezing probe 205. As the substance freezes, impurities are gradually pushed out of the crystal lattice, leaving aligned crystals that do not refract light.

In some embodiments, the second thermal gradient is created along a longitudinal axis of the directional freezing probe. Directional freezing can be initiated along the second thermal gradient. The second thermal gradient can be actively controlled to enable variable rates to freeze the substance.

In some embodiments, the mold further comprises a marking to indicate the directional freezing is completed. The marking can be a single mark on the entire circumference of the raised edge of the recessed well or a series of marks on the raised edge of the recessed well.

In some embodiments, the mold comprises a top cavity shell and a base cavity shell that can be separated from each other. The top cavity shell and base cavity shell can be combined and secured via a locking mechanism that when combined, forms the interior chamber of the mold that contains the substance during the directional freezing process.

In some embodiments, the directional freezing probe comprises a base thermally connected or attached to the supply side of the thermoelectric heat pump and a tip portion extending through the mounting hole. The diameter of the base is greater than or equal to a diameter of the tip portion to allow easier removal of the mold from the directional freezing probe once the frozen substance has been formed.

In some embodiments, the directional freezing probe comprises a nucleation site. The nucleation site can be an indentation or a raised portion, such as a bump, on the surface of the directional freezing probe. The nucleation site can serve as an initial location on the directional freezing probe where the directional freezing process begins.

Although depicted herein as a series of steps, one or more steps may not be performed or can be performed in a different order. The embodiments depicted herein do not limit the disclosure.

None of the description in this application should be read as implying that any particular element, step, or function is an essential element that must be included in the claim scope. Moreover, none of the claims is intended to invoke 35 U.S.C. § 112(f) unless the exact words "means for" are followed by a participle.

What is claimed is:

1. An apparatus to form a frozen substance from a liquid substance using directional freezing, the apparatus comprising:

a mold structured with an interior chamber structured to contain the liquid substance, the mold having a mounting hole in an end thereof; and a directional freezing assembly including:

a directional freezing probe being configured to insert in the mounting hole of the mold and being configured to extend into the interior chamber of the mold, a surface of the directional freezing probe having a nucleation site, a seal configured to seal between the directional freezing probe and the mounting hole in the mold; and a cold plate thermally connected to the directional freezing probe outside of the mold, and configured to dissipate heat drawn from the directional freezing probe to a surrounding environment, wherein the nucleation site of the directional freezing probe is configured to initiate an aligned crystal lattice for a clear ice formation formed by directional freezing of the liquid substance in thermal contact with the directional freezing probe and is configured to continue the directional freezing through the liquid substance to fill the interior chamber with the clear ice formation of the frozen substance, the mold and the frozen substance being removable from the directional freezing probe, the mold being removable from the frozen substance filing the interior chamber.

2. The apparatus of claim 1, wherein, based on the directional freezing probe being cooled, a first thermal gradient is created that is initiated at the directional freezing probe and continues through the liquid substance and the mold to a surrounding environment.

3. The apparatus of claim 2, wherein, based on the directional freezing probe being cooled, a second thermal gradient is created along a longitudinal axis of the directional freezing probe, the directional freezing being initiated along the second thermal gradient.

4. The apparatus of claim 1, wherein the mounting hole is located at a base for the end of the mold and is configured to receive the directional freezing probe to extend into the interior chamber of the mold; and wherein the mold further comprises a filler hole arranged opposite of the mounting hole and configured to receive the liquid substance into the interior chamber.

5. The apparatus of claim 4, wherein the mold further comprises a marking to indicate the directional freezing is complete.

6. The apparatus of claim 1, wherein:

the mold comprises a top cavity shell and a base cavity shell; and the top cavity shell and base cavity shell are separable.

7. The apparatus of claim 1, wherein:

the directional freezing probe comprises a base thermally connected to the plate and a tip portion extending into the mold; and a diameter of the base is greater than or equal to a diameter of the tip portion.

8. The apparatus of claim 1, further comprising an agitator configured to induce energy or motion into the liquid substance during the directional freezing of the liquid substance.

9. The apparatus of claim 1, wherein the directional freezing probe comprises a detachable portion.

10. The apparatus of claim 1, further comprising a thermoelectric heat pump configured with a supply side to provide cooling and heating functions based on a direction of input electricity across the thermoelectric heat pump.

11. The apparatus of claim 10, further comprising a controller configured to control cooling provided by the thermoelectric heat pump over time.

12. The apparatus of claim 10, further comprising a heat sink and a phase change material (PCM) that is integrated into the heat sink or attached to the heat sink in direct thermal communication.

13. The apparatus of claim 1, wherein the directional freezing probe comprises the seal seated in a groove that is configured to be received by the mold.

14. The apparatus of claim 13, wherein the seal is an O-ring seal.

15. The apparatus of claim 1, wherein the directional freezing probe is formed in a dome shape.

16. The apparatus of claim 1, wherein the directional freezing probe can be retracted from the mold during directional freezing.

17. The apparatus of claim 1, wherein the nucleation site is defined as an indentation in the surface of the directional freezing probe.

18. The apparatus of claim 1, wherein, based on the directional freezing probe being cooled, a first thermal gradient is created that is initiated at the nucleation site of the directional freezing probe and continues through the liquid substance and the mold to a surrounding environment.

19. The apparatus of claim 18, wherein, based on the directional freezing probe being cooled, a second thermal gradient is created along a longitudinal axis of the directional freezing probe, the directional freezing being initiated along the second thermal gradient.

* * * * *